US007908774B2

(12) United States Patent
Mirza et al.

(10) Patent No.: US 7,908,774 B2
(45) Date of Patent: Mar. 22, 2011

(54) INSOLE FOR A SHOE AND ACCESSORIES THEREFOR

(76) Inventors: Tariq Mirza, London (GB); Andrew Neil Brodie, London (GB); Noel James Akers, Hertfordshire (GB)

( * ) Notice: Subject to any disclaimer, the term of this patent is extended or adjusted under 35 U.S.C. 154(b) by 860 days.

(21) Appl. No.: 10/570,570

(22) PCT Filed: Sep. 2, 2004

(86) PCT No.: PCT/GB2004/003750

§ 371 (c)(1),
(2), (4) Date: Jun. 21, 2007

(87) PCT Pub. No.: WO2005/020734

PCT Pub. Date: Mar. 10, 2005

(65) Prior Publication Data

US 2007/0271826 A1 Nov. 29, 2007

(30) Foreign Application Priority Data

Sep. 2, 2003 (GB) ..... 0320546.5

(51) Int. Cl.
*A43B 23/00* (2006.01)
*A43B 13/38* (2006.01)

(52) U.S. Cl. ..... 36/137; 36/43; 36/139

(58) Field of Classification Search ..... 36/137, 36/43, 139, 138, 132, 136, 44
See application file for complete search history.

(56) References Cited

U.S. PATENT DOCUMENTS

| | | | | | |
|---|---|---|---|---|---|
| 1,824,832 | A | * | 9/1931 | Netherland | 36/70 R |
| 2,489,368 | A | * | 11/1949 | Faybert | 36/72 R |
| 3,810,318 | A | * | 5/1974 | Epstein | 36/105 |
| 5,090,140 | A | * | 2/1992 | Sessa | 36/138 |
| 5,323,650 | A | | 6/1994 | Fullen et al. | |
| 5,381,615 | A | * | 1/1995 | MacMillan | 36/137 |
| 5,456,032 | A | * | 10/1995 | Matsumoto et al. | 36/137 |
| 5,461,188 | A | * | 10/1995 | Drago et al. | 36/137 |
| 5,821,858 | A | * | 10/1998 | Stone | 36/137 |

FOREIGN PATENT DOCUMENTS

| | | |
|---|---|---|
| GB | 2352551 A | 1/2001 |
| WO | PCT/GB87/00913 | 6/1988 |
| WO | PCT/US94/00773 | 7/1994 |
| WO | PCT/IT01/004422 | 2/2002 |

* cited by examiner

*Primary Examiner* — Ted Kavanaugh
(74) *Attorney, Agent, or Firm* — Kimberly A. Chasteen

(57) ABSTRACT

An insole (102) for a shoe is provided, having a display surface (116), preferably disposed on an insert, for the display of information when the insole is in place in a shoe. A shoe (10), for example a sports shoe, is also provided having a receiver disposed on its external surface. The receiver retains an insert having a display surface, visible when the shoe is being worn and adapted for the display of information. The display surface may carry a brand or other design and/or emit light or sound by means of a suitable emission device. An accessory for a shoe comprises a mount for securing to a shoe, the mount having a display surface adapted to be visible when the shoe is being worn. The mount preferably holds an insert of the kind mentioned above.

16 Claims, 13 Drawing Sheets

INSOLE FOR A SHOE AND ACCESSORIES THEREFOR

CROSS REFERENCE TO RELATED APPLICATION

This application is a U.S. application filed under 35 USC 111(a) claiming benefit under 35 USC 120 and 365(c) of PCT International Application No. PCT/GB2004/003750 filed on Sep. 2, 2004, which is hereby incorporated herein by reference.

BACKGROUND OF THE INVENTION

1. Field of the Invention

The present invention relates to shoes and accessories therefore, in particular an accessory for attachment to the exterior of the shoe and an insole for use with the shoe.

2. Description of Related Art

In the present specification, references to a "shoe" or "shoes" are not to be taken as being limited to a single type of footwear, but are to be interpreted as embracing all forms of footwear, including but not limited to shoes, training shoes, sports shoes, such as running shoes and soccer boots, sandals, boots, plimsolls, slippers and the like. Other items of footwear are also embraced by this term, including roller skates, ice skates, ski and snowboard boots, other sporting footwear, and the like. The terms "shoe" and "shoes" are used herein to refer to this generic group of items, unless otherwise specified.

It is established practice to adorn the exterior of shoes with patterns and markings. A very common form of pattern or marking is the branding of the exterior surface of the shoe with a branded pattern or design or one or more trademarks. Such branding may be carried out by incorporating into the structure of the shoe materials or fabrics having one or more colors or designs visible from the exterior of the shoe.

Alternatively, it is known to affix to the exterior of the shoe, for example, by stitching or adhesive, patches of fabric bearing the design, brand, trademark or logo.

From the point of view of the consumer or purchaser of the shoe, hitherto, once the purchase of the particular shoe has been made, the new owner is confined to the particular design of shoe. To date, there has been little opportunity provided to the purchasers of shoes to change the appearance and overall design of shoes, once purchased. Given the high purchase price of many shoes, this can be seen to be a significant disadvantage to the purchaser and wearer of these items.

In addition to the aforementioned methods of providing patterns and designs to shoes, it is also known to provide certain designs of shoes, in particular training shoes, with certain light emitting means. Generally, such light emitting means are located in the sole of the shoe, more specifically in or adjacent the heel portion of the sole. In one known structure, the sole of the shoe is provided with a pressure-activated energy source, such as a piezo electric unit, generating a sufficient electrical power to emit light by means of a light emitting diode or the like. This arrangement is encased within the plastic sole of the training shoe and is activated by the motion of the foot of the wearer when the wearer is walking or running. The sole of the shoe is provided with at least a portion comprising a sufficiently transparent material for the light to be visible from the exterior of the shoe when being worn by the wearer. While such light emitting shoe designs have proven popular, once again there is no possibility provided to the purchaser or wearer to modify or vary the light emitting properties of the shoe.

U.S. Pat. No. 5,813,148 discloses an item of footwear, such as a shoe, with optical fiber illuminating display areas and a control module for the same. The shoe comprises a display panel on a portion of the shoe illuminated by light emitted from optical fibers extending from a light emitting device located in the sole of the shoe. A control module is located in the sole of the shoe, in particular the heel, and comprises the light emitting device, together with control components, a power source, such as a battery, and a switch, such as a pressure switch or a motion sensor.

The device of U.S. Pat. No. 5,813,148 provides a means of generating a display on the upper of a shoe. However, the arrangement is an integral part of the shoe and leaves the purchaser of the shoe with a single design of display. In addition, should the control device malfunction or the battery become exhausted, the display elements of the shoe are rendered inoperative. This could be well before the shoe is worn out and in need of replacement.

Accordingly, there is a need for an improved means for personalizing a shoe and providing a versatile system for accessorizing a shoe with a display. In particular, it would be advantageous is such a system could be used with existing shoes, obviating the need to purchase completely new shoes having the display feature.

SUMMARY OF THE INVENTION

The present invention provides, in a general aspect, means for displaying information on an exterior surface of the shoe, such that the display of invention is visible when the shoe is being worn, the display means comprising a visible surface and/or comprising an emitter for emitting light or sound, wherein the display means is such that the information being displayed may be varied or altered.

In a first aspect, the present invention provides an insole for a shoe comprising an insole portion for extending within the shoe and an insole extension, the extension comprising a surface adapted to display information, the extension being adapted to extend from within the interior such that the surface is visible from the exterior of the shoe when the shoe is being worn.

The insole may be provided in a range of colors, designs and sizes, thus allowing an existing shoe to be customized by the user with a minimum of alteration to the fabric and structure of the shoe. This allows the same shoe to be customized in a variety of ways and with a variety of designs in a simple and inexpensive way.

In order to provide the insole with a greater degree of versatility, it is preferred to provide the insole with a first portion for lying adjacent the exterior of the upper of the shoe, the display surface being positionable in one of a plurality of positions in relation to the first portion. Preferably, the insole extension comprises a second portion, the first portion disposed between the insole portion and the second portion, the display surface being disposed on the second portion. In a preferred embodiment, the first and second portions have corresponding first and second sides, the display surface being disposed on the second side of the second portion, the insole comprising means to releasably fasten the first side of the second portion to the first side of the first portion. A most suitable fastening means is a hook and loop fastener. However, other fastening devices, such as releasable studs, buttons, clips or the like, may also be employed. In this way, a single insole corresponding to a given shoe size may be adapted to fit a wide range of designs of shoe uppers, such that the display surface can be rendered visible on each shoe design. In this way, a single insole product can be made available to users having a variety of different shoes. In addition, it is generally the case that an individual user will have more than one pair of shoes. While these are all of the same size, to fit the user, the design of the shoes, in particular the upper of the shoes, can vary to a large extent. By way of the preferred embodiment of the insole, the user may employ the same insole in more than one shoe and simply adapt the position of the display surface according to the shape and size of the upper of the shoe in which the insole is to be used.

Preferably, the insole extension extends from the heel portion of the insole portion of the insole. In this way, the insole extension can be arranged to protrude from the opening of a shoe, such as a training shoe, and be visible from the exterior of the shoe when being worn. Preferably, the insole extension extends from the insole portion, so as to protrude from the opening of the shoe at the heel.

The insole extension, by protruding from within the shoe is effective in changing or modifying the visual appearance of the shoe, in particular the upper of the shoe. As discussed hereinbefore, the insole extension may therefore be provided with any desired form of pattern or ornament. In one preferred embodiment the surface of the insole extension is adapted to carry a brand. As noted above, it is common practice to provide the external surfaces of shoes with one or more brands. Accordingly, the display surface is preferably adapted to display a brand. In this respect the term "brand" is to be taken as a general reference to specific brands, trademarks, badges of allegiance, names, such as names of sport clubs, musical groups and the like, emblems, logos, slogans, caricatures, cartoons, and the like.

Alternatively, or in addition to the brand, the insole extension may comprise an emitter for emitting light and/or sound. In such a case, it is preferable to provide the insole with an energy source for the emitter. The energy source may be a pressure-activated generator, such as the piezo electric device discussed above. Alternatively, the insole may be provided with an energy storage device such as a battery, which may be located in the insole extension or other part of the insole. Location of the battery in the insole extension allows the battery to be easily accessed and replaced when discharged, without removing the insole from the shoe. In one preferred arrangement, the energy source is pressure-activated by the foot of a wearer of the shoe into which the insole has been inserted. A preferred way of achieving this is to provide the insole with one or more pressure-activated switches. The insole may comprise a pressure-activated switch in the portion of the insole portion adjacent the heel of the user when in use. Alternatively, the insole may comprise a pressure-activated switch in the portion of the insole portion adjacent the ball of the foot or toes of the user when in use.

The insole may comprise a first pressure-activated switch in the portion of the insole portion adjacent the heel of the user when in use and a second pressure-activated switch in the insole portion adjacent the ball of the foot or the toes of the user when in use, the action of the user when walking or running causing successive activation of the first and second pressure-activated switches. In this particularly effective arrangement, the insole comprises a plurality of pressure-activated switches, disposed in the insole, whereby pressure is brought to bear on respective switches according to the action being performed by the user when in use. Thus, one pattern of activation can be generated when the user is walking or running. In this case, the switches in the heel and toe portions of the insole are successively activated, giving rise to a distinctive pattern in the display as the user takes a stride. In other activities, such as jumping, pressure may be applied to the switches in the insole at the same time, giving rise to a different pattern in the display. In the case of riding a bicycle, pressure is applied to insole only at the toe-portion. Such activities will generate a different pattern of activation of the switches and can be used to generate further different patterns in the display.

The insole may comprise any suitable means for generating a powered display. One preferred embodiment comprises an array of light emitting devices for producing a display at the display surface. The array is preferably located adjacent the display surface in the extension portion of the insole. The array may comprise an array of any suitable light emitting devices. Particularly preferred are light emitting diodes (LEDs).

The insole preferably comprises a controller for controlling the display produced at the display surface. This is particularly advantageous when the insole comprises a plurality of pressure-activated switches and/or an extensive array of light emitting devices. In this way, the controller may be employed to generate a complex display, such as slogans, phrases, moving images and the like. In such an arrangement, it is preferred that the controller is remotely programmable. The insole preferably comprises a connector for connecting the controller to a remote programming device, such as a computer.

In one preferred embodiment, the insole extension comprises a housing and an insert, the insert having the surface visible from the exterior of the shoe when the shoe is being worn. Most preferably, the insert is readily removable from the housing. In this way, the user is easily able, by exchanging or replacing the insert in the housing, to modify the overall appearance and design of the shoe, in particular the upper. In embodiments where the insole comprises an emitter for light and/or sound, it is preferred that the emitter and any energy storage device are both located within the insert. The controller, if present, may be located in the insole, or in the insert. If the controller is in the insert, it may be preprogrammed to effect the desired display. In such a case, a plurality or set of different inserts may be envisaged for use with a single insole, thus allowing the user to obtain a variety of different display effects simply by exchanging the insert in the housing.

If the insert and insole are to be operated in response to pressure activated switches in the insole portion of the insole, an insert connector is required in the insole, in order to provide electrical connection between the switches in the insole and the display components in the insert.

In a further aspect, the present invention provides an insole having an insole extension comprising a housing as hereinbefore described for receiving an insert. Such an insole may be provided with one or a plurality of different inserts for location in the housing.

The present invention also provides an insert for use with such an insole.

The present invention also provides a kit comprising an insole or an insert for an insole, of the type comprising a programmable controller, the kit further comprising a storage device, such as a disk or ROM device, on which is stored a computer program for programming the controller. The kit advantageously comprises a cable for connecting the controller to a remote programming device, such as a computer.

It will be understood that the embodiments and features of the insole and the means of generating a display described above may also be incorporated into the structure of a shoe. The advantage of the insole of the present invention is that it is readily used in shoes of many different designs and configurations, whereas incorporating the aforementioned display means into the structure of a shoe necessarily confine the display to that one shoe.

In a further aspect, the present invention provides a shoe comprising a receiver disposed on an external surface of the shoe and an insert disposed within the receiver, the insert having a display surface when disposed within the receiver, the display surface being adapted to be visible for the display of information when the shoe is being worn.

The receiver may be disposed on any suitable portion of the exterior of the shoe, for example the visible portion of the sole of the shoe visible when the shoe is being worn. In a preferred embodiment, the receiver is disposed on the upper of the shoe.

In the case of shoes, such as training shoes, where an opening is defined into which the foot of the wearer is inserted, it is particularly preferred to locate the receiver adjacent this opening. One particularly preferred location for the receiver is the heel portion of the shoe upper.

In a particularly preferred embodiment the insert is removable from the receiver. In this way, the purchaser of the shoe is able to vary the overall appearance and design of the shoe by changing the insert located in the receiver. The shoe may be provided together with a plurality of different inserts. Alternatively, inserts of different designs may be provided separate from the shoe as an accessory.

The display surface is preferably adapted to display a brand, as hereinbefore defined.

However, other displays may equally well be contemplated, in particular displays of patterns or designs selected by the user of the shoe.

In an alternative embodiment, the insert comprises an emitter for emitting light or sound.

The shoe preferably comprises an energy source for powering the emitter.

The energy source may be any suitable means, for example, the pressure activated piezo electric device discussed hereinbefore. Alternatively, the shoe may be provided with a means for storing energy, such as a battery. In such a case, the energy storage means is preferably located in the insert.

As noted above, the receiver is mounted on the exterior of the shoe, so that the visible surface may be viewed when the shoe is being worn. In one embodiment of the present invention, the receiver is mounted to a removable component of the shoe.

Such removable components include a shoelace. In a third arrangement, the receiver is attached to an insole extending within the shoe.

In a further aspect, the present invention provides a shoe having a receiver as herein before defined, the receiver being adapted to receive an insert as hereinbefore defined and described. In addition, the present invention provides an insert as hereinbefore defined.

The aspects of the display, including the use of pressure-activated switches, a display array, and a controller described above in connection with the insole of the present invention also apply equally to the shoe of the present invention.

The present invention also provides a kit comprising a shoe or an insert for a shoe, of the type comprising a programmable controller, the kit further comprising a storage device, such as a disk or ROM device, on which is stored a computer program for programming the controller. The kit advantageously comprises a cable for connecting the controller to a remote programming device, such as a computer.

The aspects of the invention discussed above relate to a shoe for manufacture and sale with the capability to vary the pattern and design of the shoe. In addition, however, the present invention also provides a means whereby existing shoes can be modified or customized in accordance with the general concept of this invention, such that the appearance and design of a pre-existing shoe may also be readily altered.

Accordingly, a further aspect of the present invention provides an accessory for a shoe, the accessory comprising a mount for securing to a shoe, the mount comprising a display surface being adapted for the display of information when the shoe is being worn.

The mount is preferably adapted for securing to the shoe upper. To facilitate this, the mount is preferably provided with a clasp. The clasp is of such an arrangement that the mount may be securely fastened to the shoe, without the fabric or structure of the shoe being damaged or destroyed. The clasp may be any suitable design of hook, clip, or the like suitable for fulfilling this requirement. The clasp may be adapted to secure the mount at any desired location on the exterior of the shoe, for example, by attaching to a shoelace, a buckle, a strap or the tongue of the shoe. Preferably, the clasp is arranged to allow the mount to be secured adjacent the opening of a shoe, such as a training shoe, intended to receive the foot of the wearer. In one preferred embodiment, the clasp is arranged to secure the mount to the heel portion adjacent the opening of the shoe. The visible surface is preferably adapted to display a brand, as hereinbefore defined and described. As an alternative to, or in addition to, the mount may comprise an emitter for emitting sound and light. The means for powering the emitter are as hereinbefore described. In one preferred arrangement, the accessory is provided with the energy source for powering the emitter, thus rendering the accessory self-contained.

In one preferred embodiment, the accessory comprises a portion for extending into the shoe. The said portion is preferably arranged to be trapped between the foot of the shoe wearer and the inner surface of the shoe, thereby helping to retain the accessory in place. A particularly preferred embodiment is to have the portion extending into the shoe as an insole. However, the portion extending into the shoe may be a partial insole, for example being retained only in the heel portion of the shoe, adjacent the heel of a user.

A preferred embodiment of the accessory is one in which the mount comprises a housing, the visible surface being disposed on an insert retained in the housing. In order to allow the user to vary the overall design and appearance of the accessory and the shoe, the insert is preferably removable from the housing. In such cases, any emitters present in the accessory are most preferably located within the insert, together with their energy source. In such cases, the accessory may be provided with a single insert, or, alternatively, a plurality of different inserts, thereby providing the user with greater freedom to modify and alter the appearance of the shoe.

Again, the aspects of the display, including the use of pressure-activated switches, a light emitting array and a controller discussed above in connection with the insole of the present invention apply equally to the accessory.

The present invention also provides an insert for an accessory as hereinbefore described.

The present invention also provides a kit comprising an accessory or an insert for an insole, of the type comprising a programmable controller, the kit further comprising a storage device, such as a disk or ROM device, on which is stored a computer program for programming the controller. The kit advantageously comprises a cable for connecting the controller to a remote programming device, such as a computer.

BRIEF DESCRIPTION OF THE DRAWINGS

A more complete description of the subject matter of the present invention and the advantages thereof, can be achieved by the reference to the following detailed description by which reference is made to the accompanying drawings in which.

DETAILED DESCRIPTION OF THE PREFERRED EMBODIMENT

The following detailed description is of the best presently contemplated mode of carrying out the invention. This description is not to be taken in a limiting sense, but is made merely for the purpose of illustrating general principles of embodiments of the invention.

Figure 1:
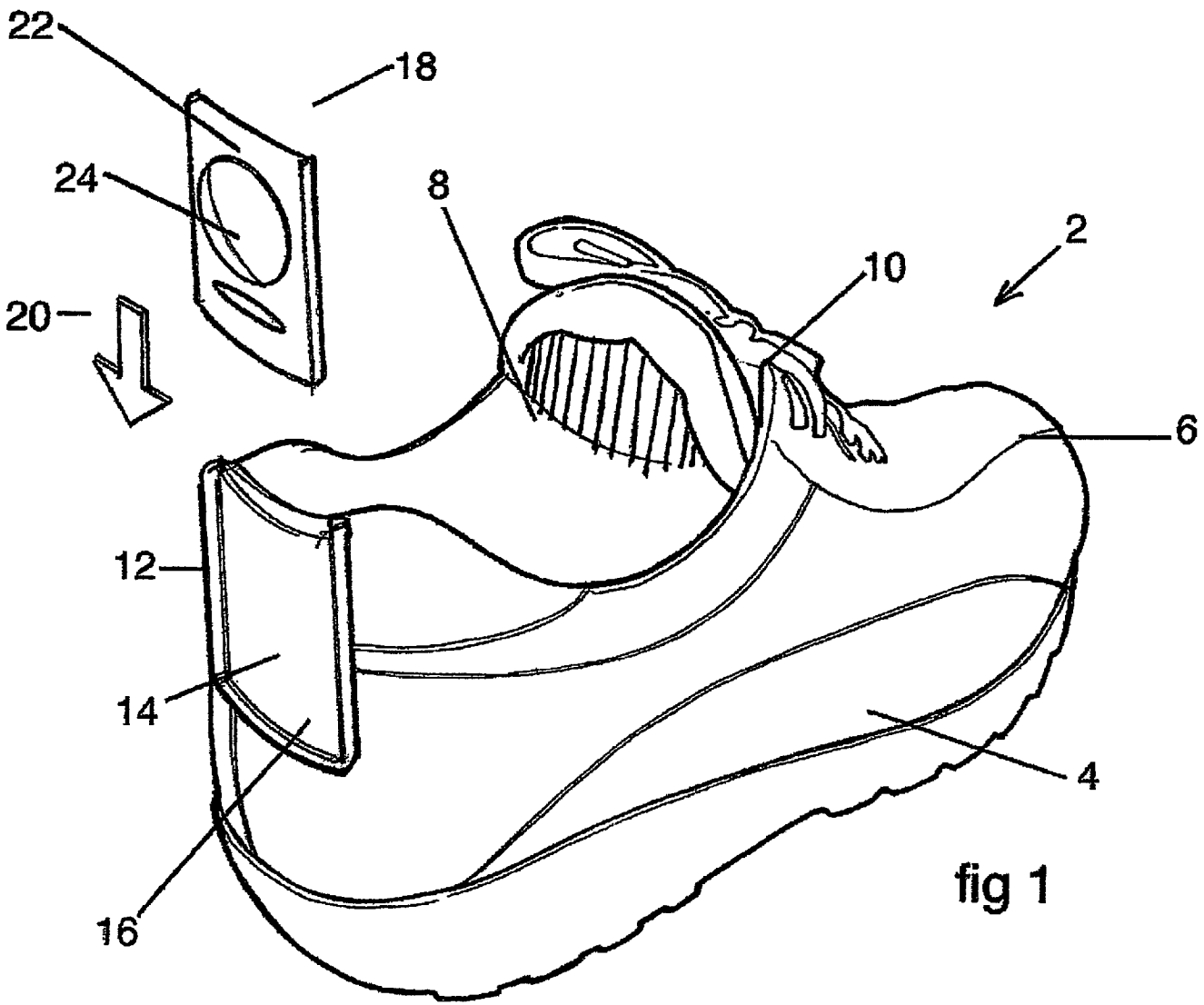
FIG. 1 is a perspective view of a shoe according to one aspect of the present invention.

Referring to FIG. 1, there is shown a training shoe, generally indicated as 2. For ease of reference, the various aspects and embodiments of the present invention will be described and illustrated having reference to a training shoe, such as shown in FIG. 1. However, as noted above, it is to be understood that the aspects and embodiments of the present invention are not limited to training shoes and are readily applicable to other items of footwear.

The shoe 2 of FIG. 1 has a sole 4 and uppers 6, both of a conventional design and construction. The shoe 2 has an opening 8 defined by an edge of 10 of the uppers 6, into which the foot of the wearer is inserted. Again, these features are of conventional, known design and construction.

The shoe 2 is further provided with a housing 12 located on the exterior of the uppers 6 at the heel of the shoe. The housing 12 has a backplate 14 attached to the uppers 6 of the shoe by known means, for example, adhesive or rivets. The housing 12 further comprises a retaining lip 16 extending along both lateral edges and the lower edge of the backplate 14. An insert 18 is adapted to be inserted into the housing 12 in the direction indicated by the arrow 20 in FIG. 1. The insert 18 and the retaining lips 16 of the housing are of dimensions such that the insert 18 is an interference fit within the housing, with the result that the insert is firmly held within the housing but free to be removed by the user, when required.

Figure 2:
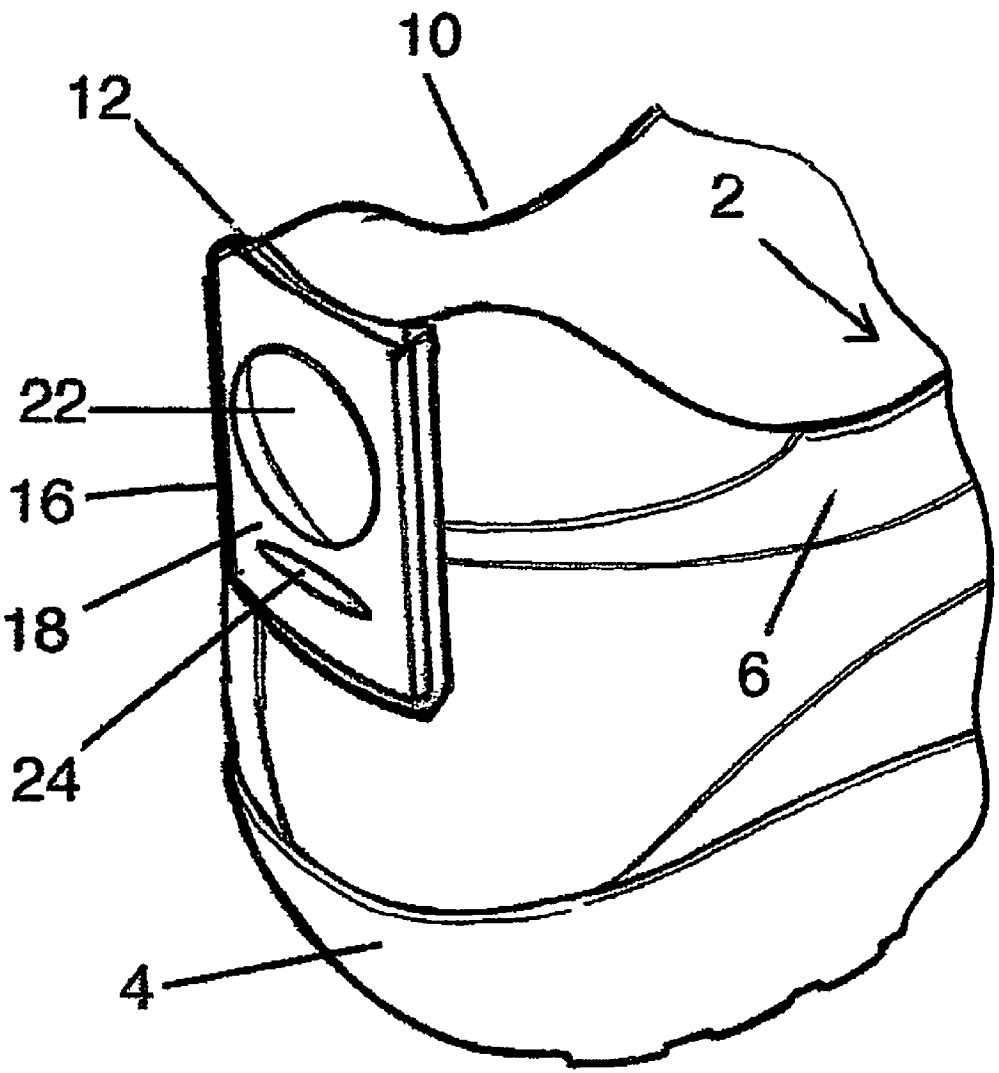
FIG. 2 is a perspective view of the heel version of the shoe of FIG. 1.
Figure 3:
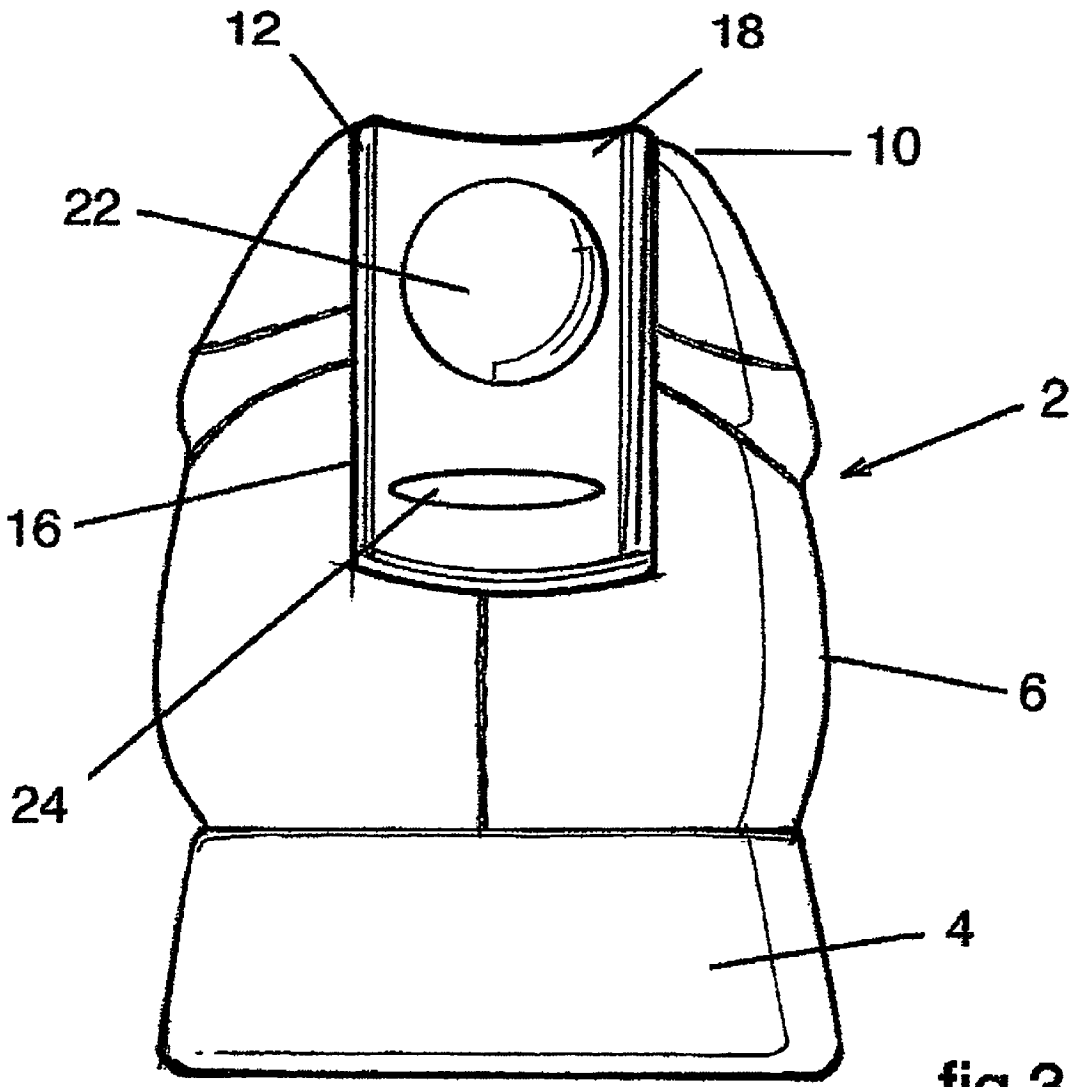
FIG. 3 is a rear elevation of the heel of the shoe of FIG. 2.

FIGS. 2 and 3 show alternative views of the heel portion of FIG. 1, with the insert 18 located in the housing 12.

Referring to the insert 18, a display surface 22 is provided on the insert, such that the display surface is visible when the insert is retained in the housing 12, as shown in FIGS. 2 and 3. The display surface 22 is adapted to receive a brand, as hereinbefore defined. In addition, the insert 18 is provided with openings 24, behind which is housed an emitter (not shown) of conventional design. Emitters appropriate for use in the insert are light emitters and sound emitters, with the light and/or sound being emitted through the opening 24. Power for the emitter is provided by a battery (not shown) housed within the insert 18. Alternatively, the shoe 2 may comprise a pressure-activated energy generator, for example a piezo electric device, of known design, for powering the emitter.

The insert 18 may be provided with any combination of colors, brands, sound or light display as desired by the user. It will be appreciated that the great advantage of the embodiment shown in FIGS. 1 to 3 is that the user, by simply replacing one insert with another can very quickly change the overall appearance and design of the shoe 2.

Figure 4:
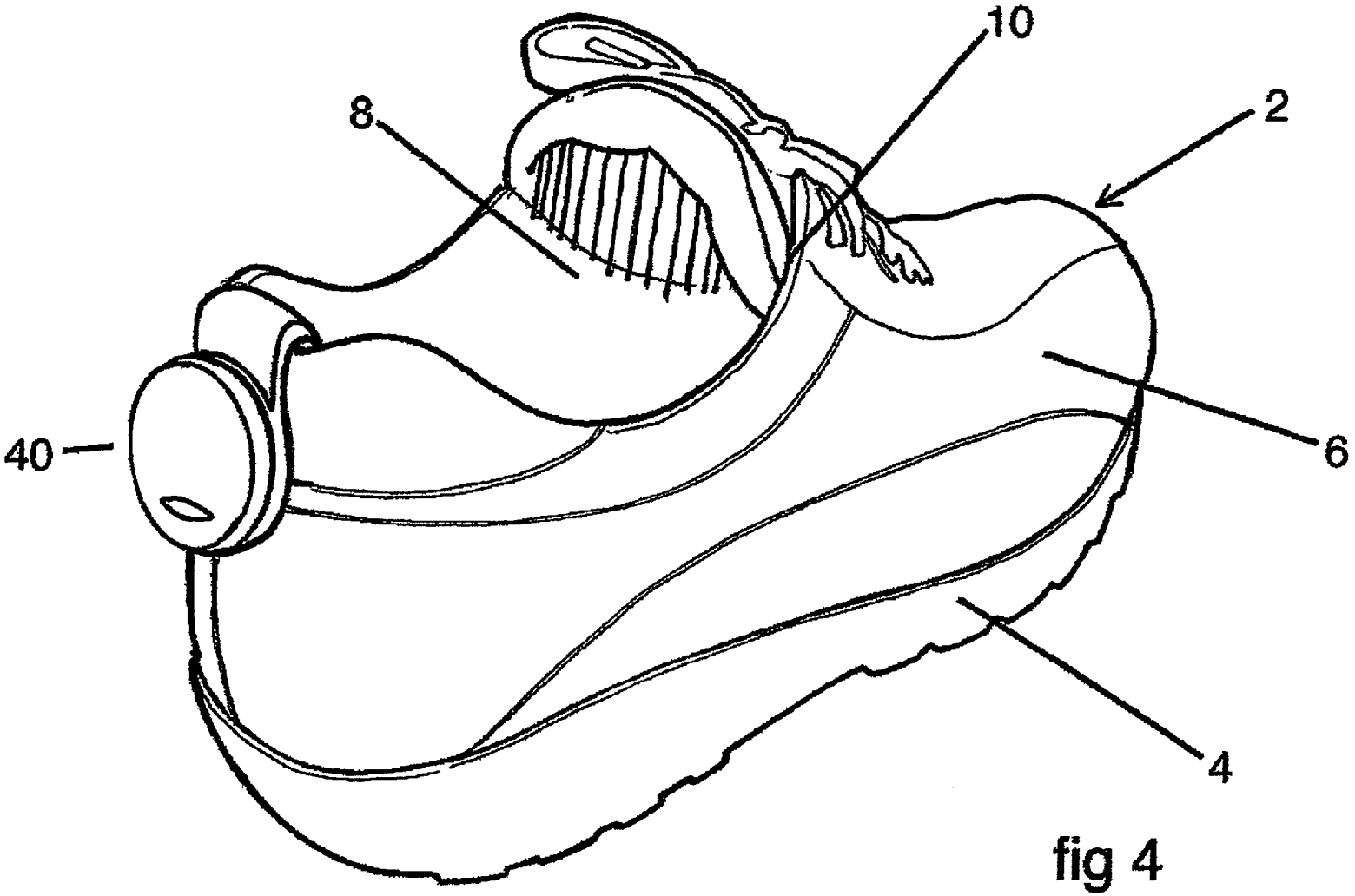
FIG. 4 is a perspective view of a pair of shoes, each carrying an accessory according to the present invention.

Referring now to FIGS. 4 to 7, there is shown an accessory for a shoe according to a further aspect of the present invention. FIG. 4 shows a pair of shoes 2 of the same design and construction as the shoe of FIG. 1. Accordingly, the components of the shoes of FIG. 4 common to the shoe of FIG. 2 are indicated using the same reference numerals.

Figure 5:
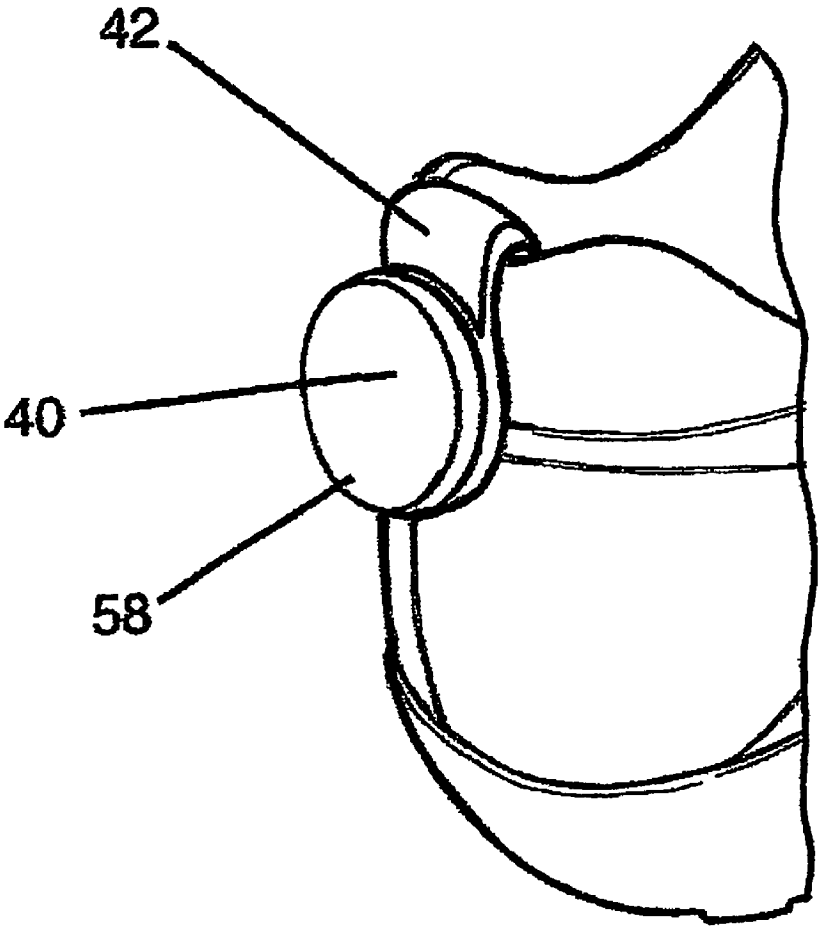
FIG. 5 is a perspective view of the heel portion of one of the shoes of FIG. 4.

An accessory 40 according to the present invention is shown located on the heel portion of the upper 6 of each of the shoes of FIG. 4. FIG. 5 shows a further view of the heel portion of one of the shoes 2 of FIG. 4 with the accessory 40 in place.

Figure 7:
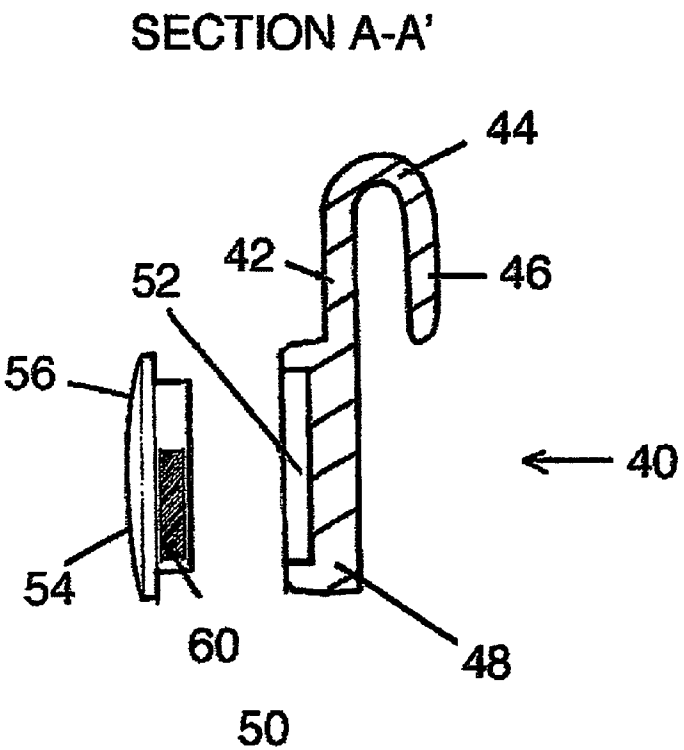
FIG. 7 is a cross sectional view of the accessory of FIG. 6 along the line VII-VII.
Figure 6:
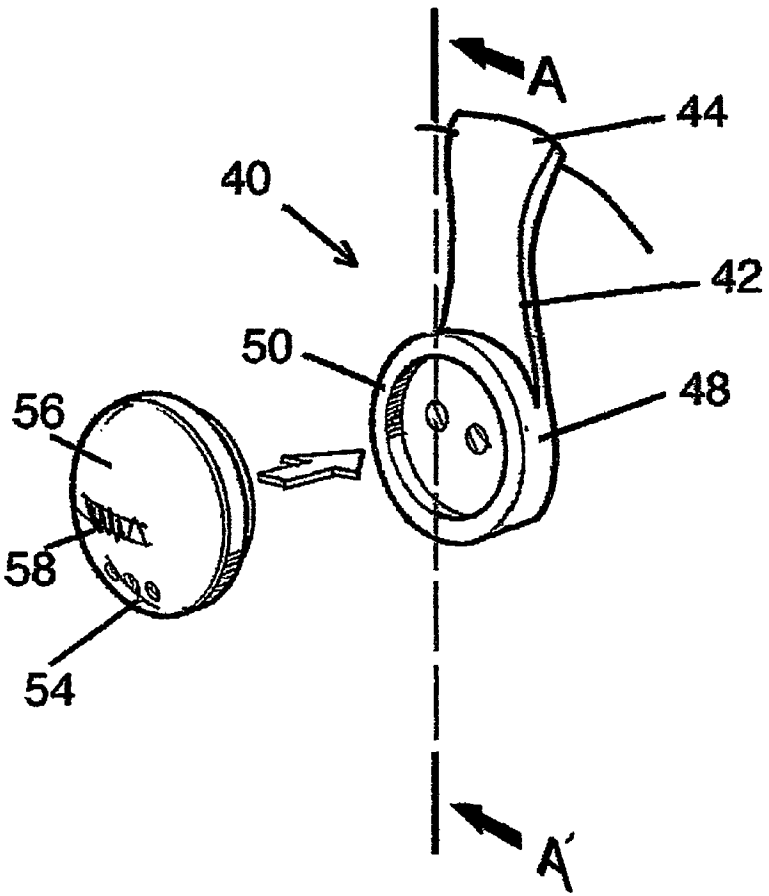
FIG. 6 is a perspective view of an accessory according to the present invention.

The accessory 40 is shown in greater detail in FIGS. 6 and 7.

Referring to these figures, the accessory 40 comprises a mount 42 having a clasp 44 for engaging the edge 10 of the opening 8 of the shoe 2. As shown more clearly in FIG. 7, the clasp 44 is in the form of a simple sprung hook, having a hook member 46 for extending into the opening 8 of the shoe 2. The clasp 44 grips the fabric of the uppers 6 at the edge 10 to hold the accessory 40 in place on the shoe. When the shoe is being worn, the foot of the wearer bears against the hook member 46 extending within the shoe and further serves to keep the accessory 40 in place.

The accessory further comprises a housing 48 connected to the clasp 42. The housing 48 is of a generally circular construction having a circular retaining lip 50 defining a recess 52. A generally circular insert 54 is dimensioned to be an interference fit in the recess 52, such that the insert is retained in the housing, but readily removable when desired by the user. The insert 54 is of a similar construction to the insert 18 described above. Thus, the insert 54 has a visible exterior surface 56. Openings 58 in the surface 56 of the insert 54 are provided for the emission of light and/or sound as discussed above. A battery 60, visible in FIG. 7 is provided to power the emitter.

The accessory 40 may be provided in a range of colors and designs, allowing a wide variety of design changes to be made to a single pair of shoes, in particular the uppers.

The insert 54 maybe provided with a wide range of colors, brands and light and/or sound emitters, allowing a wide range of different visual and audio effects to be achieved by simply changing the insert in the accessory.

The display of the shoe and accessory may be controlled by a controller, that may be preprogrammed or remotely programmable, as will be described hereinafter.

Figure 8:
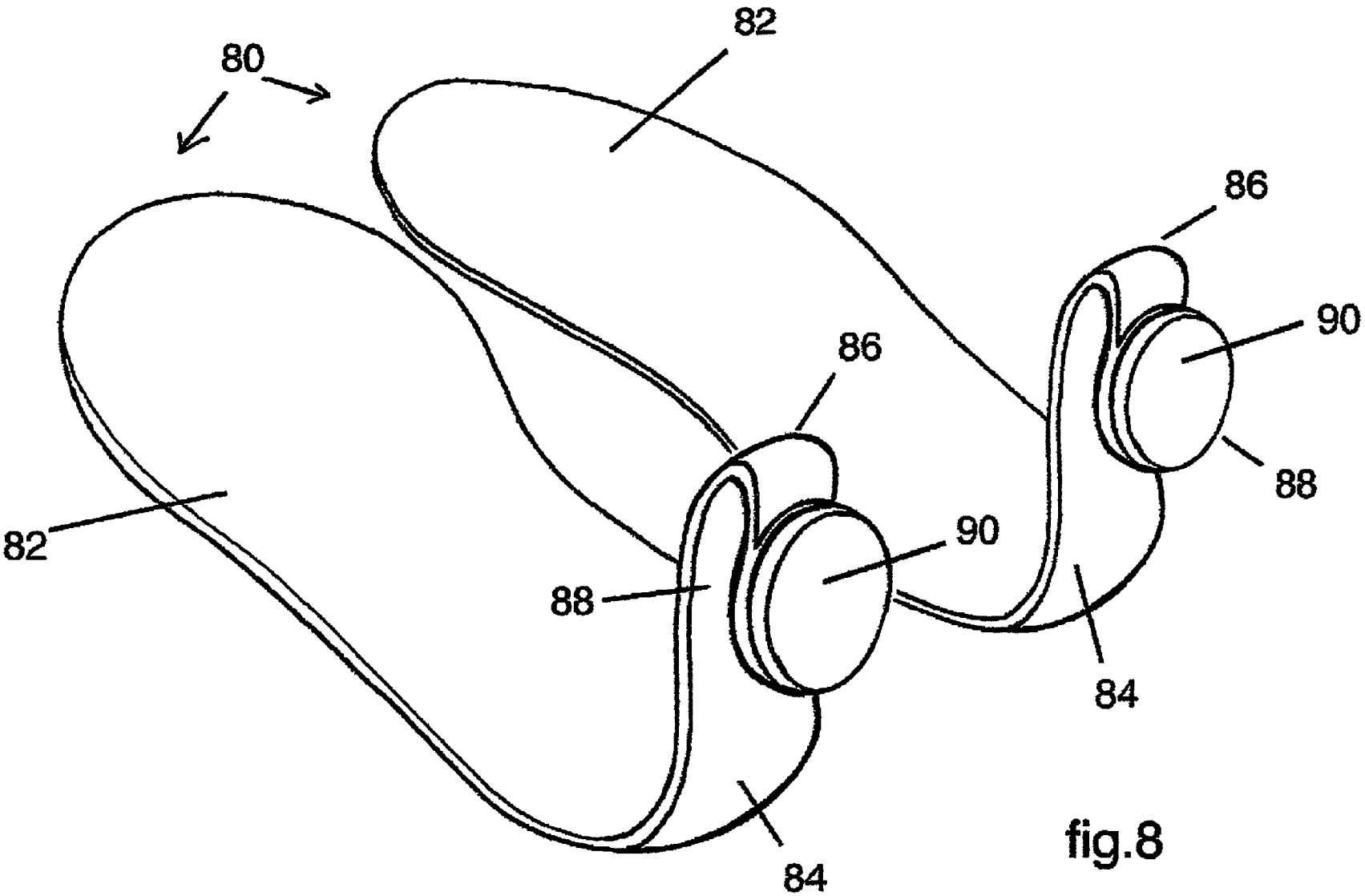
FIG. 8 is a perspective view of a pair of insoles according to one embodiment of the insoles of the present invention.
Figure 9:
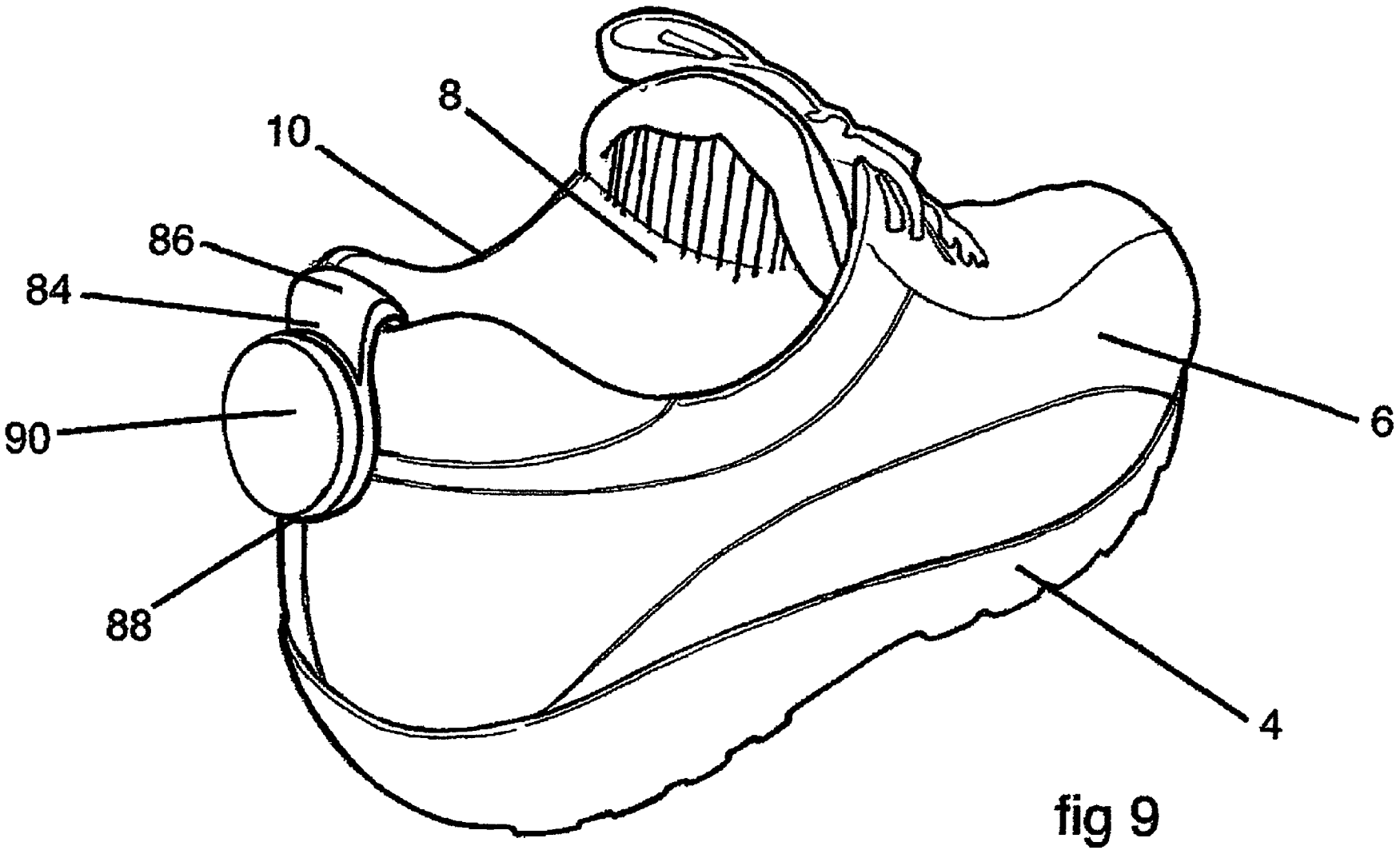
FIG. 9 is a perspective view of a shoe having installed therein an insole of FIG. 8.
Figure 10:
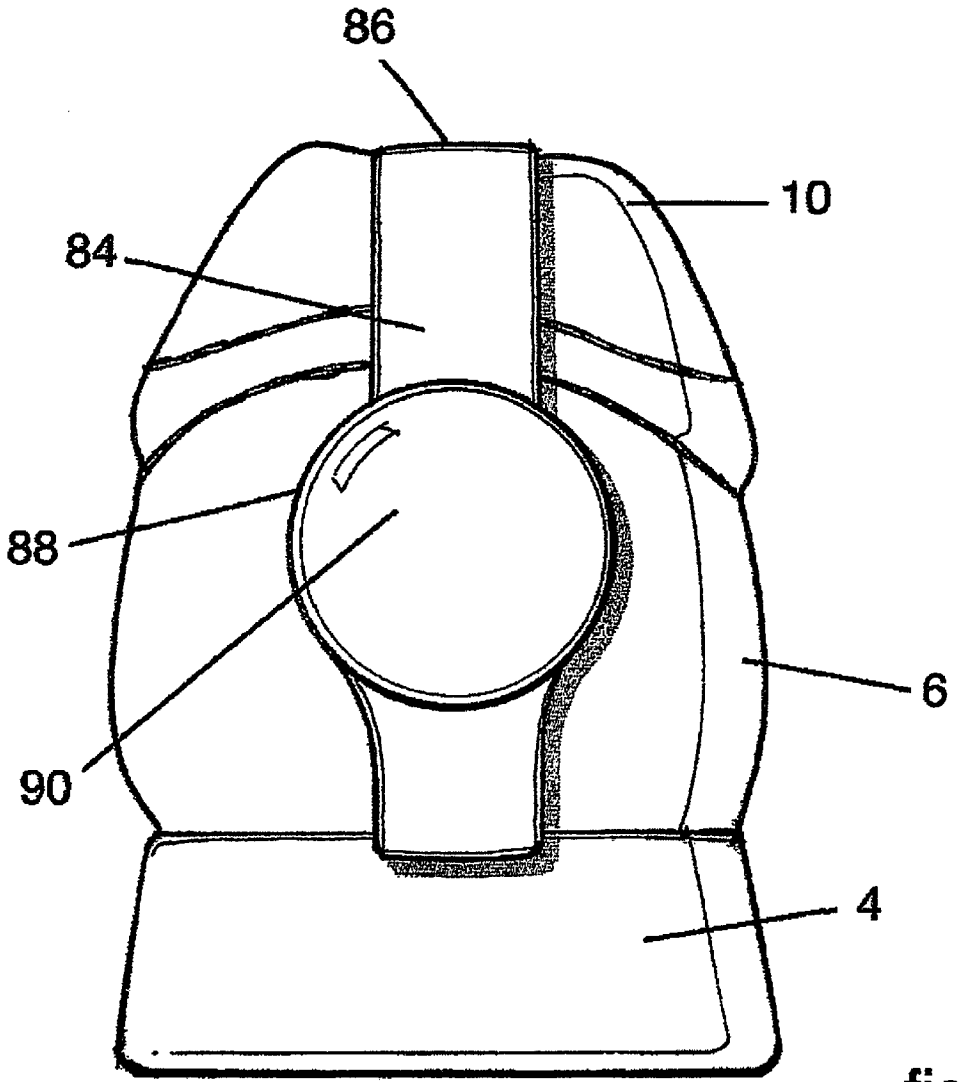
FIG. 10 is a rear elevation of the heel of the shoe of FIG. 9.

Turning to FIG. 8, there is shown a pair of insoles, generally indicated as 80, according to a further aspect of the present invention. The insole 80 comprises an insole portion 82 for extending within a shoe in a conventional manner. The insole 80 is provided with an insole extension 84. As shown in FIG. 8, the insole extension extends from the heel portion of the insole portion 82 of the insole 80. Referring to FIGS. 9 and 10, the insole 80 is shown in place in a training shoe of the same conventional design as shown in FIG. 4. Accordingly, the same reference numerals are used to indicate the portions of the shoe of conventional design. As shown, the insole extension 84 is sufficiently long as to extend out of the opening 8 of the shoe, when the insole 80 is properly located. The insole extension 84 comprises a hooked portion 86, for engaging the edge 10 of the opening 8 of the shoe. The insole extension further comprises a housing 88 and an insert 90, both of which are of the same general design as the housing 48 and insert 54 described above.

Figure 11:
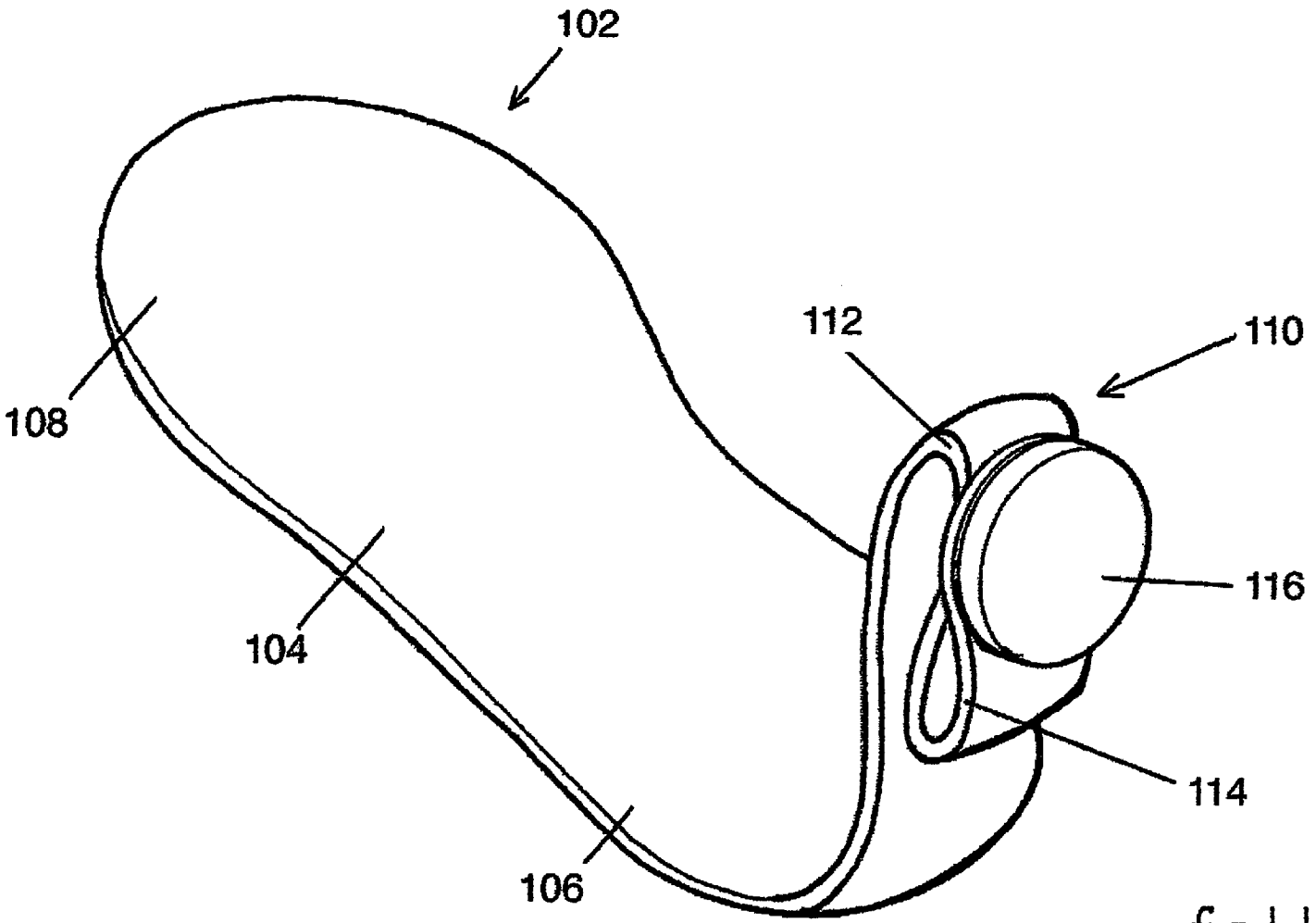
FIG. 11 is a perspective view of a second embodiment of an insole according to the present invention.

Referring to FIG. 11, there is shown, generally indicated as 102, an insole for a shoe, such as a training shoe. The insole comprises an insole portion 104, for insertion into the shoe. The insole portion comprises a heel portion 106 and a toe portion 108.

The insole 102 further comprises a insole extension, generally indicated as 110. The insole extension 110 extends upwards within the shoe and outwards from the opening of the shoe. The insole extension 110 shown in FIG. 11 is arranged to extend out from the shoe at the heel of the uppers of the shoe. Other arrangements can also be considered, for example the insole extension extending outwards from the side of the opening or outwards adjacent the tongue of the shoe.

The insole extension 110 as shown in FIG. 11 is such that the insole can be inserted in and fitted to a variety of different shoes having different designs of uppers. It is the case that the size and shape of the uppers of shoes in the region of the opening of the shoe vary greatly from design to design, even for shoes of the same foot size. For example, some shoes have a low-cut heel, while others have a high heel portion, for example to providing support and protection to the ankle of the wearer and the Achilles tendon area. This can be achieved, for example simply by having the display component removably attached to the extension portion of the insole, such that the display component can be attached to the extension portion at different positions, depending upon the design of shoe being used. The insole of FIG. 11 is adapted to be fitted to such a variety of shoe designs as follows.

The insole extension 110 comprises a first extension portion 112 for lying adjacent the upper of the shoe. A second extension portion 114 extends from the first extension portion 112 and may be folded up and against the first extension portion 112. This is shown more clearly in FIG. 12. A display component 116 is mounted on the second extension portion 114, so as to be visible when the second extension portion 114 is folded up against the first extension portion 112. A fastener 118, in particular a hook and loop fastener, secures the upfolded second extension portion 114 to the first extension portion 112, as shown in FIG. 12.

Figure 12B:
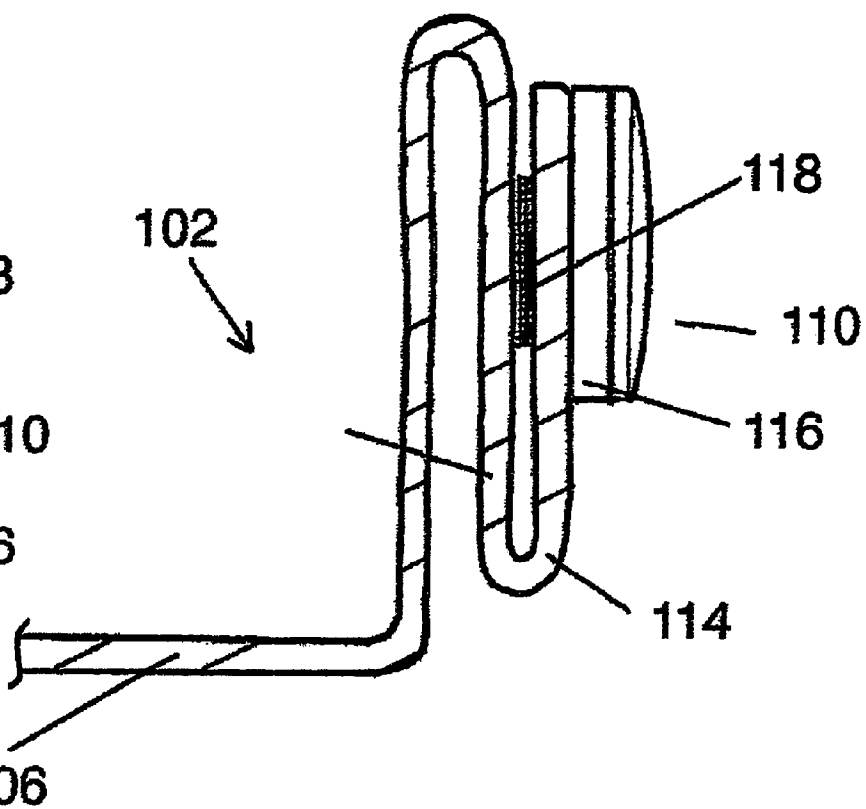
FIG. 12*b* is a cross-sectional view of the heel portion of the insole of FIG. 11 in a second position.
Figure 12A:
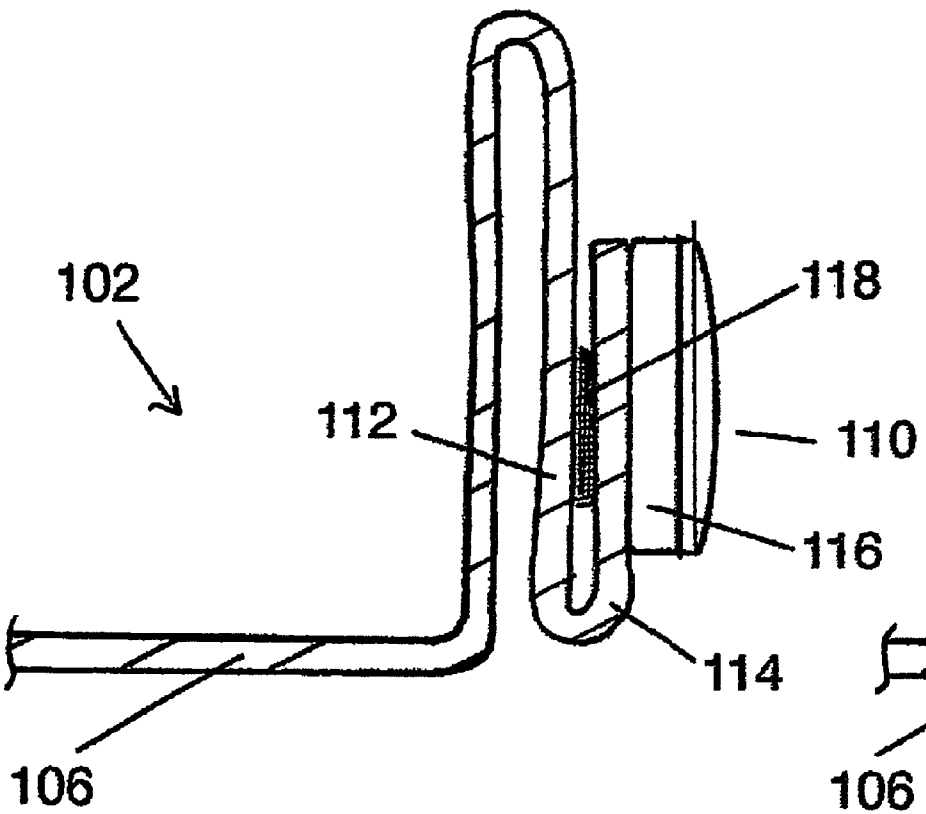
FIG. 12*a* is a cross-sectional view of the heel portion of the insole of FIG. 11 in a first position.

FIGS. 12*a* and 12*b* show the versatility of the insole of this embodiment in accommodating shoes of varying designs and size of upper. As will be seen, the insole shown in FIG. 12*b* is arranged for inserting into a shoe with a high heel upper portion, while the insole of FIG. 12*a* is for use with a shoe having a lower heel upper portion. It will be understood that the insoles may be provided with first and second extension portions even longer than those shown, in order to accommodate even higher heel upper portions, such as are found in ski boots, roller skates, ice skates, and the like.

It is preferred that the first extension portion 112 is provided with a means for stiffening, such that it can be folded over the lip of the opening of the shoe and remain in position. This stiffening means may be an inherent property of the material from which the first extension portion 112 is made, or may be provided by additional stiffening means, such as metal wires or strips. An alternative would be to provide the first extension portion with a releasable adhesive or other attachment means for securing to the upper of the shoe.

The display component 116 shown in FIGS. 11 and 12 is permanently attached to the second extension portion 114 of the insole. An alternative would be to provide the display component as a housing attached to the insole extension and an insert in the housing, such as described hereinbefore and shown in FIGS. 1 to 7.

Figure 13:
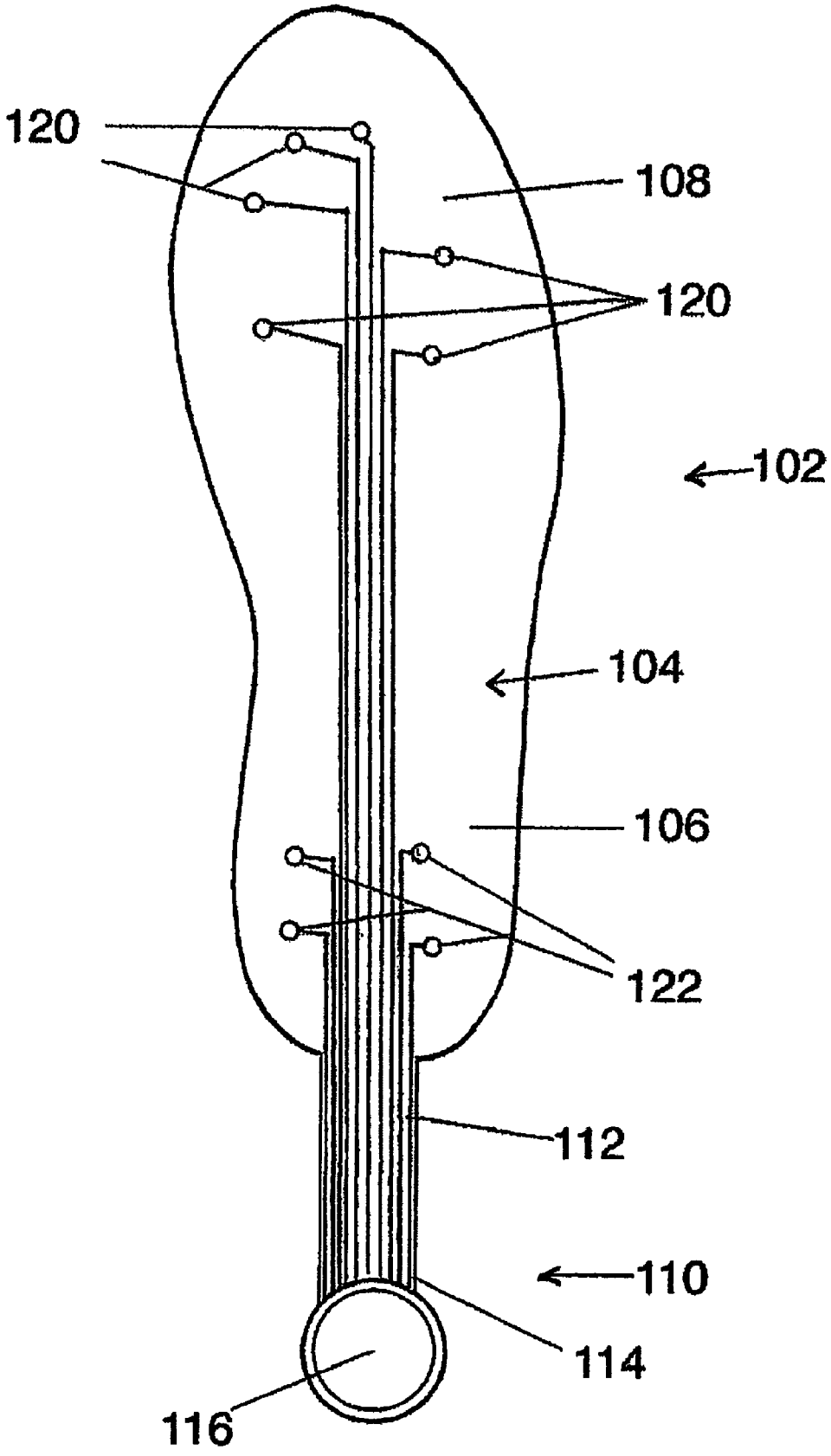
FIG. 13 is a plan view of an insole according to a further aspect of the present invention.

Referring to FIG. 13, there is shown an insole of the same general design as that of FIGS. 11 and 12. Accordingly, the same components are indicated using the same reference numerals and reference is made to the forgoing description for details of the construction of the insole of FIG. 13.

The insole 102 of FIG. 13 comprises a pressure-activated switch array, connected to a controller in the display component, as follows. An array of pressure-activated switches 120 is disposed in the toe portion 108 of the insole 102, activated by the toes and ball of the foot of the user when walking, running or performing some other activity. Similarly, an array of pressure-activated switches 122 is disposed in the heel portion 106 of the insole 102. The switches in this array 122 are activated by pressure applied by the heel of the user when moving.

A plurality of wires 124 connects each of the switches 120 and 122 in the arrays to the display element 116. The display element 116 comprises a controller, a power source, and an array of light emitting devices, in particular an LED array. This arrangement is represented schematically in FIG. 14. The display element 116, represented by the broken line in FIG. 14, houses the display 130, an array of LEDs. The array 130 shown in FIG. 14 comprises 24 LEDs. Larger or smaller arrays may be employed.

However, it is to be understood that larger arrays, comprising more LEDs, will permit more complex displays, such as graphics and the like. The display 130 is controlled by a controller 132, powered from a battery 134, and receiving signals from the pressure-activated switches 120,122 via the wires 124. The controller 132 is programmable. The controller 132 may be preprogrammed to provide a fixed set of displays to the user. This may be preferred, for example, to provide a branding function to the shoe being sold to the customer. Alternatively, the arrangement may comprise a connection, 136, for connecting the controller to an external programming device, such as a computer, for programming the display function of the controller.

Figure 14:
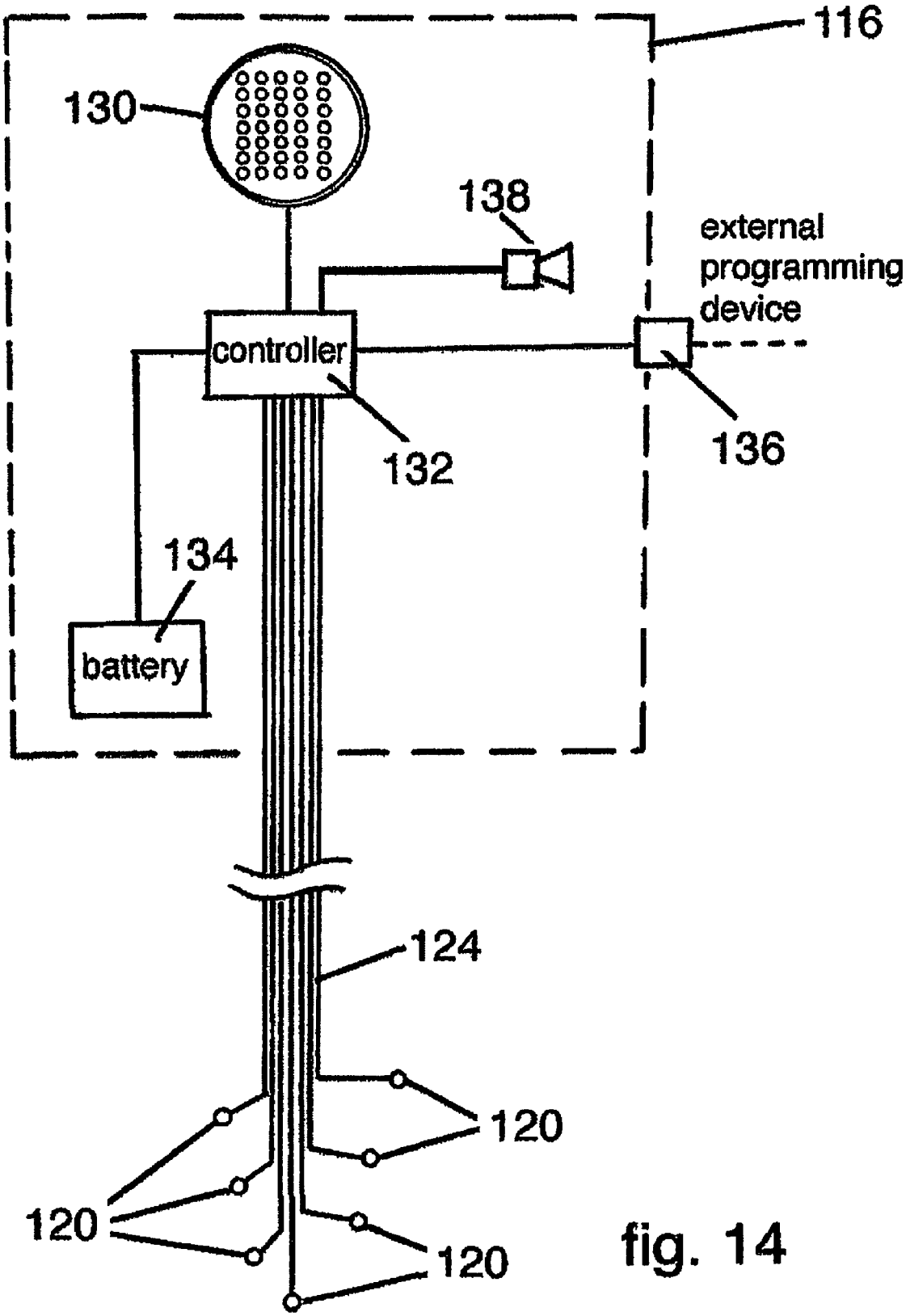
FIG. 14 is a diagrammatical representation of the control circuit of an insole of a further embodiment of the present invention.

As shown in FIG. 14, the display element may also comprise a sound emitting device 138, for emitting sound as part of the display.

In arrangements where the display element 116 is housed within a removable insert, as hereinbefore described, the insole will comprise an electrical connection for the insert to allow the controller 132 to receive signals from the pressure activated switches.

The present invention may be provided as a kit of parts comprising the following elements: a shoe, accessory or insole, or insert for the same, having a programmable display element; and a storage device, such as a diskette or other ROM device, on which is stored a computer program for programming the display controller. The kit is preferably also supplied with a means, such as a cable, for connecting the controller to a remote programming device.

It will be appreciated that the present invention in general and by way of its specific aspects and embodiments provides a means whereby the external appearance and design of a wide range of items of footwear, in particular the uppers of the shoes, can be readily and easily modified at the wish of the user according to the individual's taste and prevailing fashions. In this respect, the present invention represents a significant advantage over established and conventional forms of footwear which, by the very nature of their construction, confine the user to a single external design and appearance. The present invention, in all its various aspects, also provides a very versatile means whereby the outward appearance of a given pair of shoes can be modified and customized, either by the manufacturer or, more particularly, by the end user, according to taste, employing a large variety of designs, with little or no changes needing to be made to the item of footwear being worn.

Many improvements, modifications, and additions will be apparent to the skilled artisan without departing from the spirit and scope of the present invention as described herein and defined in the following claims.

What is claimed is:

1. An insole for insertion into an existing shoe, the insole comprising:

an insole portion for extending within the shoe, and an insole extension, said insole extension comprising a display means for showing a display, said insole extension being adapted to extend from within the interior of the shoe when the insole is located within said shoe such that said display of said display means is visible from the exterior of the shoe when the shoe is being worn; said insole extension comprising a first portion for extending from the interior of said shoe and lying adjacent the exterior of the upper of the shoe, and second portion, said first portion disposed between the insole portion and said second portion, the display means being disposed on said second portion, wherein the first and second portions have corresponding first and second sides, the display means being disposed on the second side of the second portion, the insole comprising means to releasably fasten the first side of the second portion to the first side of the first portion.

2. The insole as claimed in claim 1, wherein the releasable fastening means is a hook and loop fastener.

3. The insole as claimed in claim 1, wherein the insole extension extends from the heel position of the insole portion.

4. The insole as claimed in claim 3, wherein the display means is disposed at the heel of the shoe when the insole is in place in the shoe.

5. The insole as claimed in claim 1, wherein the insole extension comprises an emitter for emitting light or sound or a combination thereof.

6. The insole as claimed in claim 5, wherein the insole comprises an energy source for the emitter.

7. The insole as claimed in claim 6, wherein the energy source is a battery located in the insole extension.

8. The insole as claimed in claim 6, wherein the energy source is pressure-activated by the foot of a wearer of the shoe when the shoe is being worn.

9. The insole as claimed in claim 1, wherein the insole comprises a pressure-activated switch for controlling the display means.

10. The insole as claimed in claim 9, wherein the insole comprises a pressure-activated switch in the portion of the insole portion adjacent a portion of the user's foot selected from the ball of the foot, heel, or toes when in use.

11. The insole as claimed in claim 9, wherein the insole comprises a plurality of pressure-activated switches, disposed in the insole, whereby pressure is brought to bear on respective switches according to the action being performed by the user when the insole is in use.

12. The insole as claimed in claim 11, wherein the insole comprises a first pressure-activated switch in the portion of the insole portion adjacent the heel of the user when the insole is in use, and a second pressure-activated switch in the insole portion adjacent a position selected from the ball of the foot or the toes of the user when the insole is in use, the action of the user when walking or running causing successive activation of the first and second pressure-activated switches.

13. The insole as claimed in claim 1, further comprising a controller for controlling the display produced by the display means.

14. The insole as claimed in claim 13, wherein the controller is remotely programmable.

15. The insole as claimed in claim 14, further comprising a connector for connecting the controller to a remote programming device.

16. The insole as claimed in claim 1, wherein the display means is detachable from the insole.

* * * * *